United States Patent [19]

Mitchell

[11] Patent Number: 4,700,814

[45] Date of Patent: Oct. 20, 1987

[54] LOCKING DEVICE FOR RECIPROCATING MEMBERS

[75] Inventor: William D. Mitchell, Orange, Calif.

[73] Assignee: Chalco Engineering Corporation, Gardena, Calif.

[21] Appl. No.: 675,418

[22] Filed: Nov. 27, 1984

[51] Int. Cl.[4] ..... B65H 59/10

[52] U.S. Cl. ..... 188/67; 92/25; 92/27; 92/5 L; 188/75; 188/170

[58] Field of Search ..... 92/5 L, 23, 24, 25, 92/26, 27, 28; 91/41, 44; 188/67, 75, 170

[56] References Cited

U.S. PATENT DOCUMENTS

| | | | |
|---|---|---|---|
| 2,678,538 | 5/1954 | Cowan | 92/28 |
| 2,896,583 | 7/1959 | Stixrood | 92/19 |
| 3,003,473 | 10/1961 | Ottoson | 92/5 L |
| 3,359,862 | 12/1967 | Modrich | 91/44 |
| 3,398,651 | 8/1968 | Folmer | 92/27 |
| 3,777,857 | 12/1973 | Hughes | 188/170 |
| 3,826,176 | 7/1974 | Ike | 92/25 |
| 4,214,795 | 7/1980 | Kakuminato | 92/25 |
| 4,295,413 | 10/1981 | Kamimura | 92/5 L |
| 4,323,001 | 4/1982 | Masclet | 92/26 |
| 4,416,107 | 11/1983 | Hoff | 188/170 |
| 4,524,676 | 6/1985 | Rogers | 91/44 |

FOREIGN PATENT DOCUMENTS

| | | | |
|---|---|---|---|
| 117879 | 9/1979 | Japan | 92/27 |
| 442325 | 9/1974 | U.S.S.R. | 92/27 |

*Primary Examiner*—Abraham Hershkovitz
*Attorney, Agent, or Firm*—Spensley Horn Jubas & Lubitz

[57] ABSTRACT

A locking device for a circumferentially grooved reciprocating member is disclosed. In one embodiment the locking device includes a housing, through which the reciprocating member passes, having a pair of spring biased locking elements and a release element disposed therein. Locking is achieved by insertion of the locking elements into the reciprocating member circumferential groove. Unlocking is effected by displacement of the release element towards the locking elements along a line perpendicular to the reciprocating member to withdraw the locking elements. In an alternative embodiment a spring biased retention pin is provided to selectively engage and retain the release element in proximity to the locking elements. An annular ring may be disposed about the reciprocating member adjacent the circumferential groove to displace and disengage the retention pin from the release element. The locking device in either embodiment can be incorporated, interiorally or exteriorally, within existing reciprocating member actuators. In yet another embodiment the inventive locking device is incorporated within a self locking hydraulic actuator. In this embodiment a circumferentially grooved reciprocating shaft, disposed within a housing bore, is urged into an extended position by introducing working fluid through a first port. At maximum extention a locking assembly substantially as described above engages the circumferential groove to effect locking. Introducing working fluid through a second port causes engagement of a release element with the locking elements to first unlock and then retract the reciprocating shaft.

8 Claims, 7 Drawing Figures

LOCKING DEVICE FOR RECIPROCATING MEMBERS

BACKGROUND OF THE INVENTION

1. Field of the Invention

The present invention concerns locking devices for reciprocating members, and more particularly, reciprocating member locking devices of the type engaging a groove circumferentially disposed about the reciprocating member.

2. Description of the Prior Art

A reciprocating member is any form of uniformly shaped, generally elongated member, repetitively displaced along its longitudinal axis by an actuating mechanism. Reciprocating members are commonly configured as a shaft. Devices incorporating reciprocating members are well known in the prior art and enjoy a substantial number of diverse applications. Typical of devices incorporating a reciprocating member are hydraulic or pneumatic actuators. These devices usually include a piston slidingly disposed within an actuating mechanism and connected to a shaft extending beyond the actuating mechanism through a suitably configured aperture. The shaft is repetitively displaced along its longitudinal axis by the introduction of either a fluid or gas working fluid into the actuating mechanism to effect displacement of the internally disposed piston. Reciprocating members are also similarly incorporated into a wide range of devices relying on electromechanical or mechanical displacement actuators.

It is frequently desirably to lock a reciprocating member in a preselected position, commonly at its fullest extension from or retraction into an actuating mechanism. Suitable locking devices are usually disposed entirely within the actuating mechanism or located externally adjacent thereto. Reciprocating member locking devices are also well known in the prior art. A typical locking device, disclosed in U.S. Pat. No. 2,678,538, involves a pair of semi-circular jaws frictionally gripping a reciprocating shaft. Locking devices of this general nature suffer from a defect in that axially oriented displacement forces exceeding the frictional restraining force of the jaws can dislodge the reciprocating shaft. Another typical locking device, disclosed in U.S. Pat. No. 3,398,651, involves a rod engaging a circumferential groove in a reciprocating member. While locking devices of this nature do provide more secure locking by avoiding the need to rely on frictional restraining forces, these devices often fail to provide a uniform distribution of displacement restraining force about the circumference of the reciprocating member. Thus, there still exists a need to provide a locking device securely restraining a reciprocating member by engaging a circumferential groove disposed thereon while further uniformly distributing restraining forces about the circumference of the reciprocating member.

SUMMARY OF THE INVENTION

Accordingly, it is an object of the present invention to provide a locking device securely restraining a reciprocating member against axial displacement by engaging a groove circumferentially disposed about the reciprocating member to substantially uniformly distribute restraining forces about the circumference of the reciprocating member. It is a further object of the present invention to provide a locking device positively locking a reciprocating member upon engaging a circumferential groove without the application of external forces to actuate the locking device. It is yet another object of the present invention to provide an improved locking device of simplified structure which can either be disposed entirely within a reciprocating member actuating mechanism or located exteriorly and adjacent thereto.

To accomplish the foregoing and other advantages and objectives, the locking device of the present invention includes a housing, situated about a reciprocating member, having disposed therein a pair of opposing spring biased locking elements to engage a reciprocating member circumferential groove and a release wedge to disengage the locking elements from the circumferential groove. An actuation means external to the locking device displaces the release wedge along an axis perpendicular to the longitudinal axis of the reciprocating member to disengage the spring biased locking elements from the circumferential groove.

In an alternate embodiment of the present inventive locking device, a retention pin, slidingly disposed in the locking device housing parallel to the longitudinal axis of the reciprocating member, is provided to engage the release wedge and retain the wedge in a position at which the locking elements are maximally separated, thereby effectively disengaging the locking device. An annular ring disposed about the reciprocating member adjacent the circumferential groove displaces the retention pin to permit displacement of the release wedge under the internal force of the locking element biasing springs, thereby allowing engagement of the locking elements with the circumferential groove.

In yet another alternative embodiment, the locking device of the present invention is incorporated within a novel self-locking hydraulic actuation mechanism. In this alternative embodiment, a locking element housing containing spring biased locking elements, a fluid activated released wedge, and a retention pin, is incorporated within a hydraulic actuation housing further having a suitably configured reciprocating shaft slidingly disposed therein. In this embodiment, introduction of a working fluid through a first port effectuates extension of the reciprocating shaft and locking of the shaft at its fullest extension. Introduction of working fluid through a second port first effectuates unlocking of the shaft and shaft retraction thereafter.

The novel features which are believed to be characteristic of the invention, together with further objectives and advantages thereof, will be better understood from the following description considered in connection with the accompanying drawings, wherein like numbers identify like elements. It is to be expressly understood, however, that the drawings are for the purposes of illustration and description only and are not intended as a definition of the limits of the invention.

DETAILED DESCRIPTION

Figure 2:
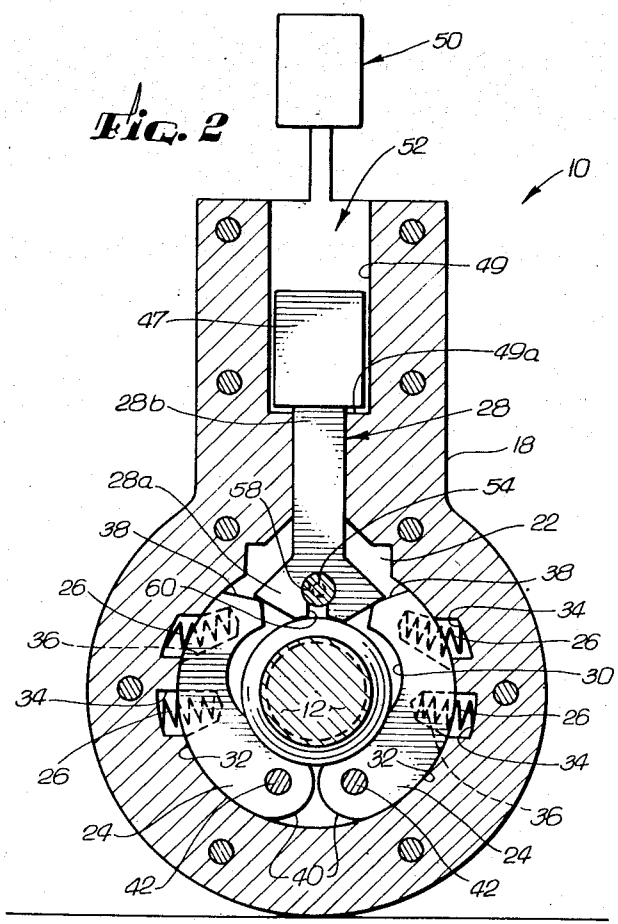
FIG. 2 is a cutaway end view of the locking device shown in FIG. 1 in an unlocked condition.
Figure 1:
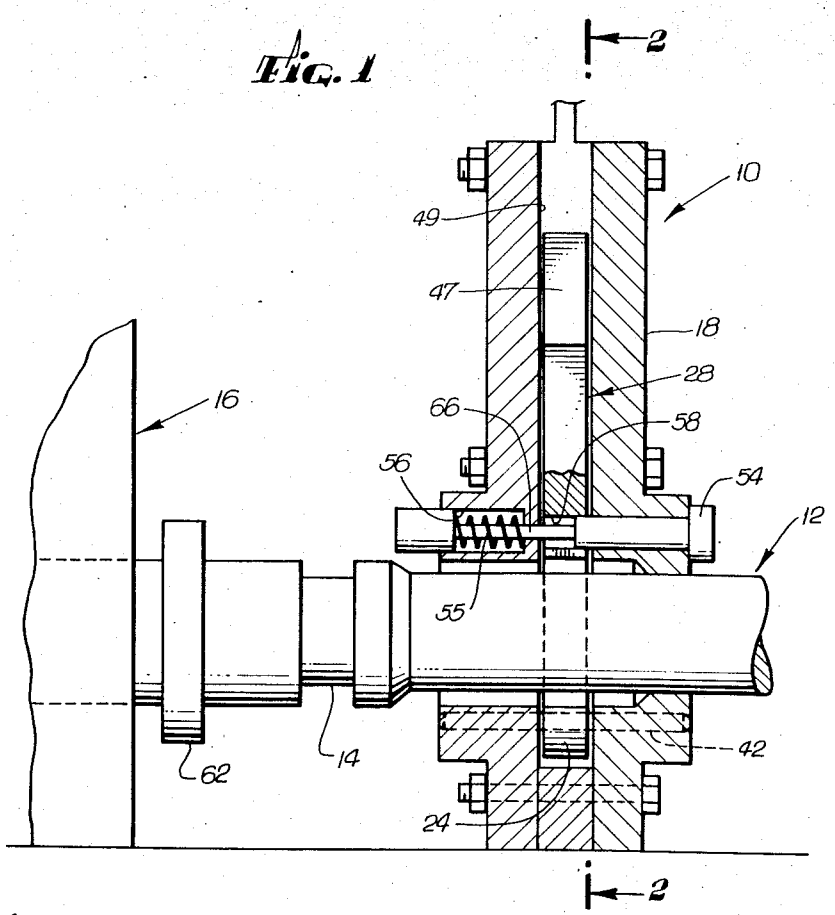
FIG. 1 is a cutaway side view of a reciprocating member locking device in accordance with a preferred embodiment of the present invention in an unlocked condition.
Figure 4:
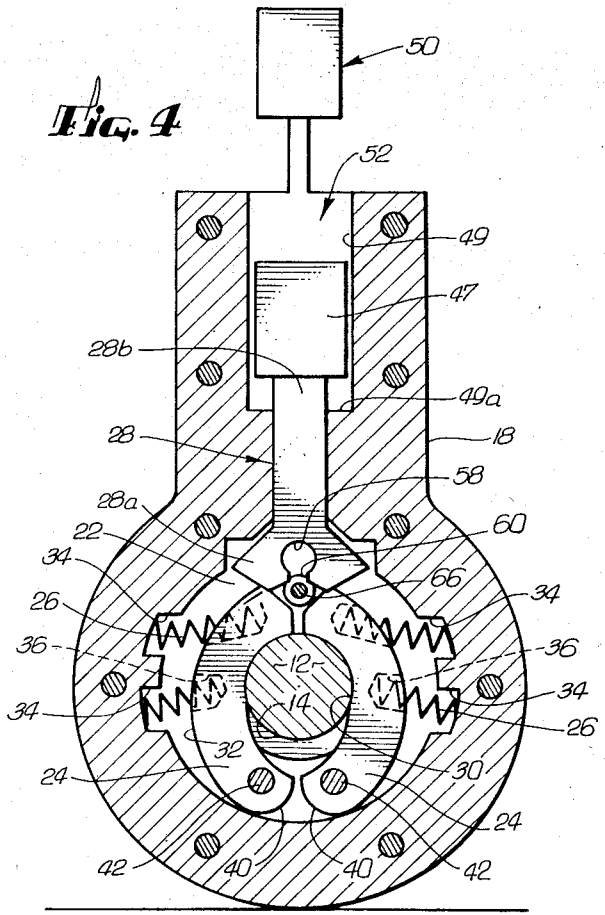
FIG. 4 is a cutaway end view of the device shown in FIG. 1 in a locked condition.
Figure 3:
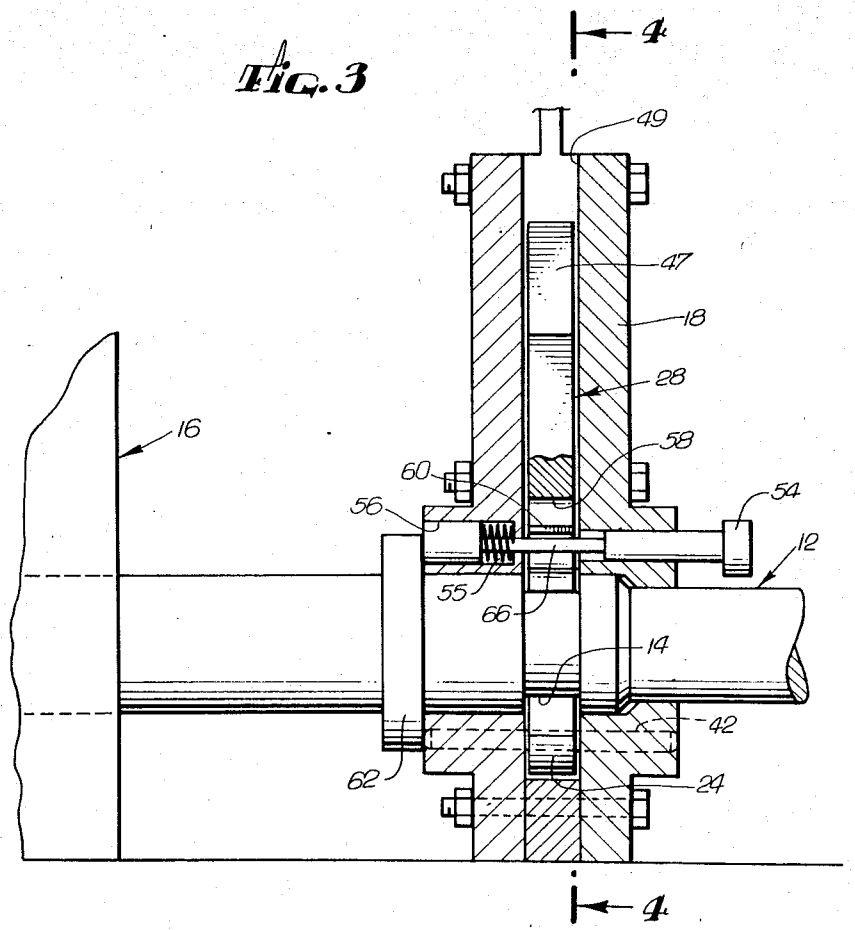
FIG. 3 is a cutaway side view of the device shown in FIG. 1 in a locked condition.

Referring to the figures, and more particularly FIG. 1 thereof, there is shown a preferred embodiment of the present inventive locking device, generally designated 10, disposed about a reciprocating member 12 having a circumferential groove 14 and undergoing axial displacement by any form of suitable actuating mechanism, generally designated as 16. Typically reciprocating member 12 is a shaft having a generally circular cross-sectional geometry, as shown in FIGS. 2 and 4. Reciprocating member 12 need not be a shaft, however, and its cross-sectional geometry may take any rectangular, hexagonal, or other generally uniform form.

As more clearly shown in FIGS. 2 and 4, locking device 10 includes a housing 18 having an aperture through which reciprocating member 12 passes. This housing aperature is shaped to approximately correspond to the cross-sectional geometry of the reciprocating member 12. The housing 18 has an internal cavity 22 within which are disposed locking and unlocking elements, including opposing curved locking elements 24, biasing springs 26, and a release wedge 28. The locking device housing 18 can have any suitably configured external geometry as may be appropriate either for incorporation within an actuating mechanism 16 or application exterior to and adjacent an actuating mechanism 16. The housing 18 may be formed from two or three separate elements, as may be desired for ease of fabrication. One or both elements of a dual element housing may be suitably machined to form housing cavity 22, or alternatively, two generally planer elements may have disposed between them a third housing element suitably configured to form cavity 22.

The curved locking elements 24, residing within cavity 22, are opposingly disposed about the housing aperture. Each locking element has an internal circumference 30 shaped to generally conform to the cross-sectional geometry of the reciprocating member 12 and an outer circumference 32 which is appropriately shaped to generally conform to the corresponding internal surfaces of the housing 18. While outer circumfrence 32 is shown as being generally curved in FIGS. 2, 4, other configurations could have been chosen without exceeding the scope of the present invention.

Both of the locking elements 24 are forced towards the reciprocating member 12 by biasing elements 26. These elements 26 are generally in a partially compressed state, being disposed between the locking elements 24 and corresponding internal surfaces of the housing 18, and are suitably secured within housing recesses 34 and locking element recesses 36.

The biasing elements 26 may be formed from any appropriately resilient material and have any configuration appropriate for urging locking elements 24 towards the reciprocating member 12 as is well known to those skilled in the art.

The locking elements 24 have first ends 38, contacting the release wedge 28 and partially curved for sliding interaction with release wedge 28. The locking elements 24 further have second ends 40, in contact with one another. In larger versions of locking device 10 locking reciprocating members 12 of greater than a few inches maximum cross-sectional length, second ends 40 are suitably curved to provide pivoting of each locking element about the point of mutual contact. In smaller versions of this embodiment of the locking device 10, appropriate for locking reciprocating members of a few inches or less of maximal cross-sectional length, the locking elements 24 are secured within the housing cavity 22 by pivot pins 42 located in proximity to second locking element ends 40 and disposed through bores in the locking elements 24.

The reciprocating member 12 is securely locked within the locking device 10 at the preselected location of the circumferential groove 14. As the circumferential groove 14 passes within the locking device housing 18, the locking elements 24 are forced into the groove 14 under the influence of the biasing elements 26. Unlocking of the reciprocating member 12 is effectuated by displacement of the release wedge 28 along an axis perpendicular to the longitudinal axis of the reciprocating member 12.

As shown in FIGS. 2 and 4, release wedge 28 is disposed within a portion of the housing cavity 22 which is configured so as to restrict movement of the release wedge 28 in a line perpendicular to the longitudinal axis of the reciprocating member 12 and lying generally in the plane of locking elements 24. The release wedge 28 has a generally flat triangular-shaped separation portion 28a oriented with an apex directed towards the reciprocating member 12. An upper portion 28b of the release wedge 28, having any generally rectangular or cylindrical configuration, is disposed within the above-described portion of housing cavity 22.

As the release wedge 28 is displaced towards the reciprocating member 12, a broader portion of release wedge separation portion 28a engages locking element first ends 38, forcing ends 38 apart, thereby causing the locking elements 24 to pivot about pivot pins 42 or, in larger embodiments of the locking device 10, causing the locking element 24 to pivot about their point of mutual contact at second ends 40. The locking elements 24 are thereby withdrawn from the circumferential groove 14, releasing reciprocating member 12 from locking device 10.

Since displacement of the release wedge 28 towards the reciprocating member 12 further compresses biasing elements 26, this displacement occurs only under the influence of an exterior force application means, generally designated 50. This exterior force application means 50 may be any form of hydraulic, pneumatic, mechanical, or electromechanical device and does not make up part of the present invention. Depending upon the environment in which the locking device 10 is applied, this exterior force application means 50 may either be disposed within the locking device housing 18 or alternatively, be disposed exterior to the locking device housing 18 and transmit a displacement force to release wedge element 28 via a suitably configured aperature 52. The exterior force application means 50 shown generally in FIGS. 2, 4 could, for example, be a pressurized hydraulic or pneumatic working fluid source.

As shown in FIGS. 2, 4, a release wedge displacement stop 47 of suitable configuration may be disposed in a locking device housing bore 49. The innermost protion 49a of bore 49 in conjunction with displacement stop 47 prevents the application of excessive force on release wedge 28 by external force means 50.

To alleviate wear on the locking device 10, or alternatively, obviate the need for continuous application of a release wedge separation force by a suitable exterior force application means 50, an alternative embodiment of the present inventive locking device further includes a retention pin 54 slidingly disposed within a bore 56 which is oriented parallel to the longitudinal axis of reciprocating member 12 and a retention pin biasing spring 55 urging retention pin 54 generally towards the recirprocating mechanism 16. In this embodiment, separation portion 29a of release wedge 28 is provided with a retention bore 58 and a connecting slot 60. When the release wedge 28 is maximally displaced towards reciprocating member 12, retention bore 58 registers with retention pin housing bore 56. During the remaining travel of release wedge separation portion 28a, release wedge slot 60 registers with retention pin housing bore 56. In this embodiment, reciprocating member 12 is provided with an annular ring 62 disposed adjacent the reciprocating member circumferential groove 14 on the side of the circumferential groove opposite the locking device 10.

In operation, starting from an initially unlocked condition, retention pin 54 is disposed within retention pin bore 56 so that a retention pin first diameter portion 64 is lodged within retention bore 58. In this position, release wedge 28 is restrained from displacement away from reciprocating member 12 since retention pin first diameter portion 64 is larger than the width of release wedge slot 60. As circumferential groove 14 approches locking device 10 and begins to align with locking elements 24, annular ring 62 engages a projecting portion of retention pin 54, thus displacing retention pin 54 so as to place a retention pin second diameter portion 66 within retention bore 58. Since retention pin second diameter portion 66 is smaller than the width of release wedge slot 60, release wedge 28 is urged away from reciprocating member 12 under the influence of biasing elements 26, thereby permitting locking elements 24 to pivot towards reciprocating member 12 and engage circumferential groove 14.

When it is desired to unlock the reciprocating member 12, release wedge 28 is again displaced towards reciprocating member 12, under the influence of external force application means 50, thereby causing locking elements 24 to pivot away from reciprocating member 12 and disengage circumferential groove 14. As circumferential groove 14 is longitudinally axially displaced away from locking device 10 under the influence of actuating mechanism 16, annular ring 62 moves away from retention pin 54. Since locking device 10 is in an "unlocked" condition through the application of external force means 50, release wedge bore 58 registers with retention pin bore 56. Retention pin biasing spring 55 then urges retention pin first diameter portion 64 into release wedge bore 58 thereby restraining further movement of release wedge 28. Exterior force application means 50 may then be relaxed without subsequent displacement of release wedge 28 until the reciprocating member 12 reverses its axial travel and annular ring 62 again engages retention pin 54.

In an alternative embodiment of the present inventive locking device (not shown) the housing recesses 34 would be configured as bores through which biasing elements 26, suitably configured as shafts, would be disposed. These biasing elements shafts would then be displaced by any appropriate form of hydraulic, pneumatic, mechanical, or electromechanical exterior force application means similar to exterior force application means 50. This external force application means would be reciprocatingly activated at any preselected position of reciprocating member 12 with respect to housing 18 so as to engage or disengage locking elements 24 in circumferential groove 14.

The locking device of the present invention, in any of the embodiments discussed above, can be incorporated into existing reciprocating member actuating mechanisms or, alternatively, novel reciprocating member actuating mechanisms such as the one discussed below. In the former case, the locking device can be attached to an exterior portion of a reciprocating member actuating mechanism housing and engage a circumferential groove formed in an existing reciprocating member, or the locking device may be suitably affixed to the reciprocating member actuating mechanism housing so as to engage a following shaft, having a circumferential groove, suitably attached to the external end of the reciprocating member. The locking device can also be incorporated within an existing reciprocating member actuating mechanism housing by extending the actuating mechanism housing an appropriate length at an end opposite the end from which the reciprocating member exits the actuating mechanism housing. In this instance, a reciprocating member following shaft could be attached to the internal end of the reciprocating member.

Figure 5:
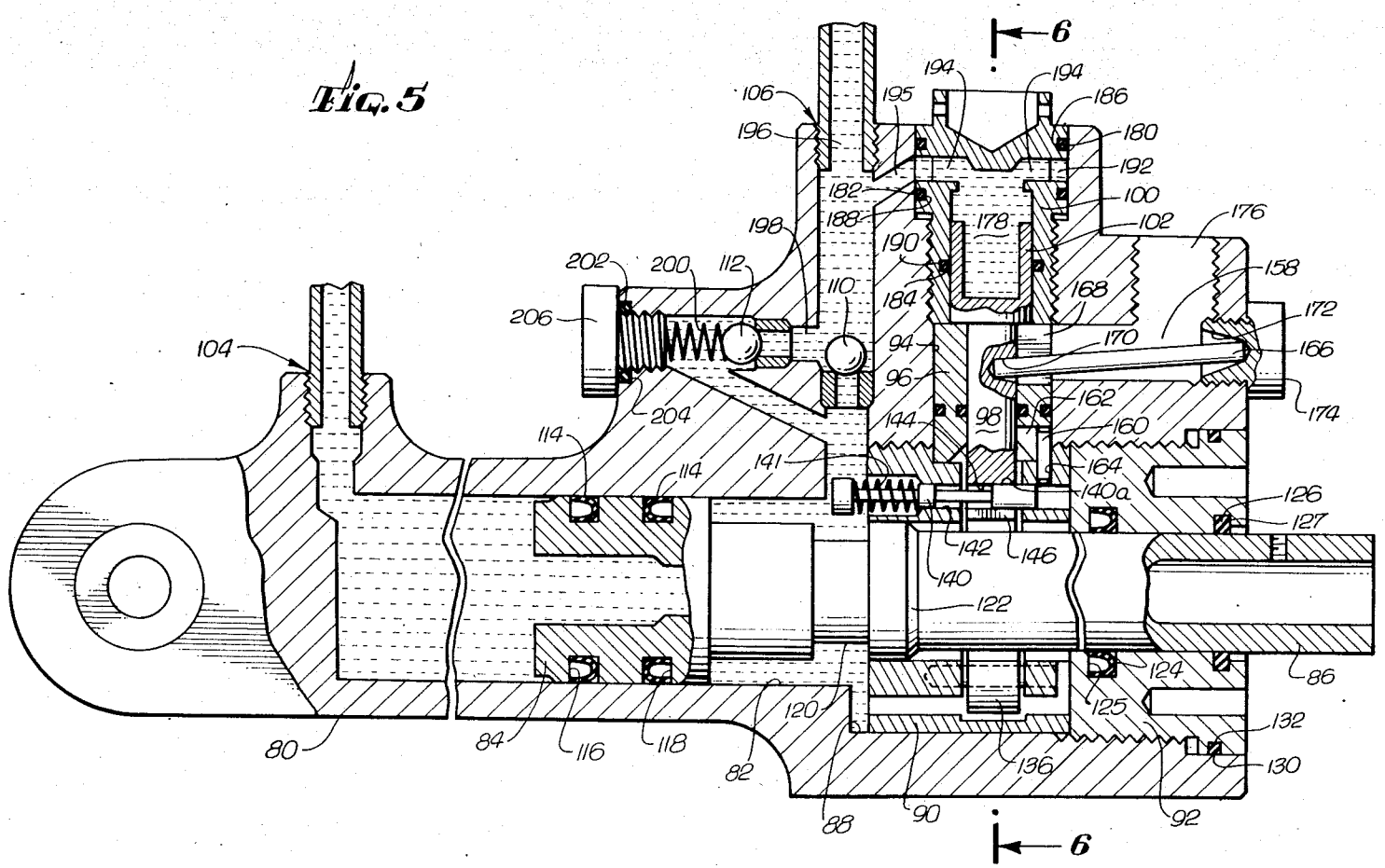
FIG. 5 is a cutaway side view of an internally contained self-locking hydraulic actuation device in accordance with an alternative embodiment of the present invention.

As a further embodiment of the present invention, a novel, internally contained self-locking hydraulic actuator is presented. As shown in FIG. 5, the self-locking hydraulic actuator includes a housing 80 having a first hydraulic bore 82, within which is slidingly received a hydraulic piston 84 and connecting reciprocating shaft 86. A second bore 88, parallel to and communicating with the first hydraulic bore 82, receives a locking element housing 90 and reciprocating shaft sealing cylinder 92. A third hydraulic housing bore 94, oriented within housing 80 perpendicular to first bore 82 and second bore 88 slidingly receives a release wedge sealing cylinder 96, within which is slidingly disposed a release wedge shaft 98. A release piston housing cylinder 100, within which is slidingly disposed a release piston 102, is threaded onto an aperture portion of third housing bore 94. The housing 80 further contains an extension port 104, retraction port 106, check valve 110 and back pressure valve 112.

The hydraulic piston 84 divides the first hydraulic housing bore 80 into first and second chambers such that introduction of working fluid through extension port 104 causes reciprocating shaft 86 to extend from the hydraulic housing 80 while introduction of working fluid through retraction port 106 causes reciprocating shaft 86 to retract into the hydraulic housing 80.

Piston 84 is provided with standard "U" cup seals 114 residing within appropriately configured groves 116, 118 to effect sealing between the two chamber portions of first hydraulic bore 82. Standard "U" cup seals and the configuration of their corresponding grooves are well known in the prior art, extensively used in the industry and, therefore, do not require further discussion. Hydraulic piston 84 and reciprocating shaft 86 can be formed from a single unitiary element or, alternatively, formed from two separate elements and subsequently connected. The reciprocating shaft 86 is of a smaller diameter than connecting hydraulic piston 84 and has a circumferential groove 120 and an inclined shoulder 122.

The reciprocating shaft sealing cylinder 92, threaded into second hydraulic bore 88, provides a fluid-tight extension aperture for reciprocating shaft 86. A standard "U" cup seal 124 and corresponding groove 125 are disposed about the circumference of a sealing cylinder bore through which the reciprocating shaft 86 passes to provide a fluid-tight sliding seal between reciprocating shaft 86 and sealing cylinder 92. A wiper element 126 is disposed in a corresponding groove 127 disposed about the exterior circumference of the sealing cylinder bore to remove contaminants from the surface of reciprocating shaft 86. Wiper elements and the configuration of their corresponding grooves are also well known in the prior art. A conventional O-ring 130 residing within an O-ring groove 132 disposed about the outer circumference of sealing cylinder 92 provides a fluid-tight seal between hydraulic housing 80 and sealing cylinder 92.

Figure 7:
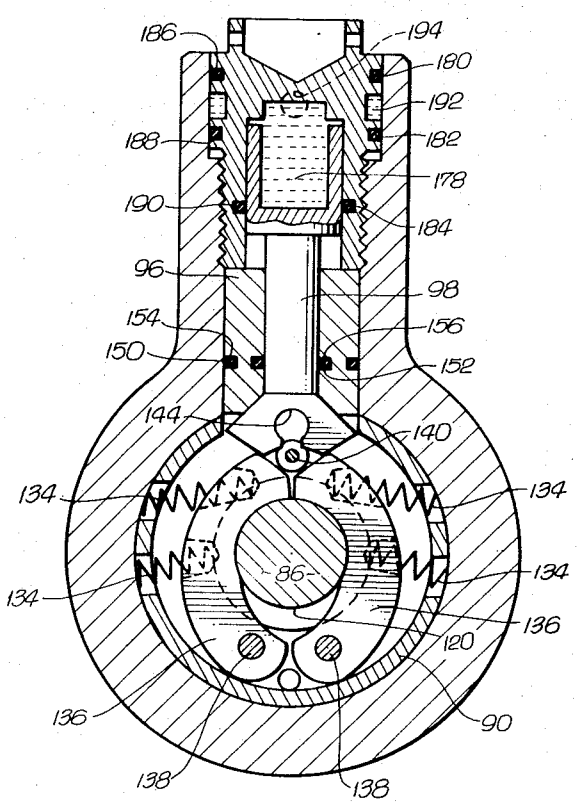
FIG. 7 is a cutaway end view of the self-locking hydraulic device shown in FIG. 5 in a locked condition.
Figure 6:
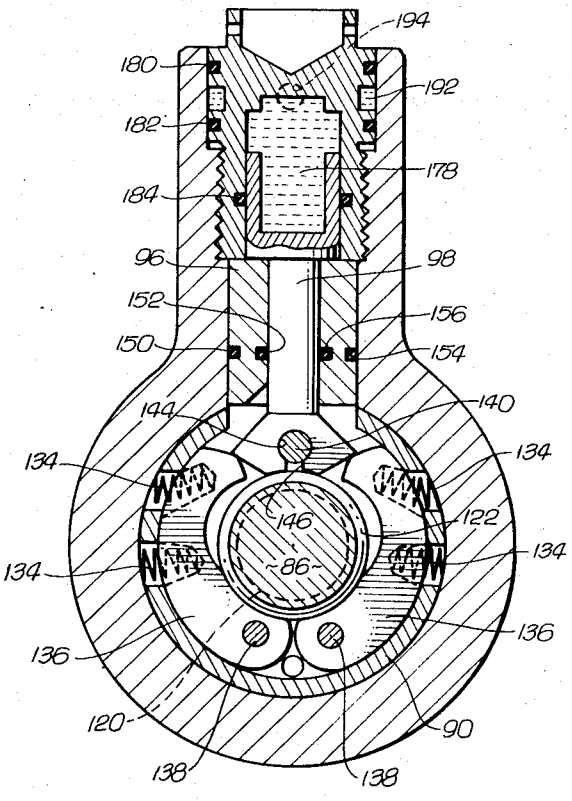
FIG. 6 is a cutaway end view of the self-locking hydraulic device shown in FIG. 5 in an unlocked condition.

As show in FIGS. 6 and 7, locking element housing 90 has disposed therein biasing springs 134, locking elements 136, and locking element pivot pins 138, all situated and interacting substantially as discussed above in connection with locking device 10. Similarly, release wedge 98 interacts with locking elements 136 as discussed above. A retention pin 140, having a first diameter portion **140*a*, and retention pin engagement spring 141 are disposed within a locking element housing bore 142 and engage a bore 144 and slot 146 in release wedge 98 again in the same manner as discussed above in connection with locking device 10**.

A release wedge sealing cylinder 96 having O-ring grooves 150, 152, with O-rings 154, 156 disposed therein, provides a fluid-tight sliding seal about release wedge 98 and further prevents the introduction of working fluid into a housing cavity 158. An orientation pin 160, residing within a groove 162 in release wedge sealing cylinder 96 and a bore 164 of locking element housing 90, provides proper orientation between the locking element housing 90, release wedge 98, and hydraulic housing 80.

An engagement rod 166, disposed within housing cavity 158 provides an indication of engagement between locking elements 136 and reciprocating shaft circular groove 120, and consequently, provides an indication of whether reciprocating shaft 86 is locked or unlocked. Engagement rod 166 passes through a second groove 168 in release wedge sealing cylinder 96 to terminate in a chamfered cavity 170 disposed within release wedge 98. The opposite end of engagement rod 166 terminates in a chamfered cavity 172 of a securing bolt 174. When the locking elements 136 engage reciprocating shaft circumferential groove 120, thereby locking reciprocating shaft 86 against longitudinal axial displacement, release wedge 98 is displaced away from reciprocating shaft 86. Engagement rod 166 is, therefore, more closely situated adjacent a housing aperture 176. Similarly, when the locking elements 136 are displaced away from circumferential groove 120, thus allowing reciprocating shaft 86 to undergo longitudinal displacement, release wedge 98 is disposed more closely to reciprocating shaft 86 and engagement rod 166 is displaced away from housing aperture 176. A suitable switching mechanism, well known in the prior art, can be threaded into housing aperture 176 to provide an electrical indication of the proximity of engagement rod 166 to aperature 176, and consequently, the locked or unlocked condition of reciprocating shaft 86.

A release piston 102, residing within release piston housing 100, is disposed immediately adjacent to release wedge 98. Fluid seals between piston 102, piston housing 100, and hydraulic housing 80 are provided by O-rings 180, 182, and 184, respectively, disposed within O-ring grooves 186, 188, and 190. Expansion of a cavity 178 formed between release piston 102 and release piston housing 100 forces release wedge 98 towards reciprocating shaft 85. Working fluid is introduced into cavity 178 via a groove 192 disposed about the periphery of release piston housing 100 and opposing bores 194 communicating between groove 192 and cavity 178. When release piston housing 100 is threaded into hydraulic housing 80, groove 192 is located adjacent a hydraulic passage 195.

Check valve 110 and back pressure valve 112, residing within fluid passages 196 and 198, respectively, are of standard construction and well known in the industry. Back pressure valve 112, biased by spring 200, is set to release at a preselected pressure. An O-ring 202 residing within a groove 204 disposed about a threaded aperture receiving backing bolt 206, provides a fluid-tight seal between backing bolt 206 and hydraulic housing 80.

In operation, the self-locking hydraulic actuator performs as follows: Starting from a condition in which reciprocating shaft 86 is fully retracted within hydraulic housing 80, the locking elements 136 are positioned away from reciprocating shaft 86 by the location of release wedge 98 in proximity to reciprocating shaft 86. Release wedge 98 is secured in this position by retention pin first diameter portion **140*a* engaging release wedge bore 144. As fluid is introduced through extraction port 104 into first hydraulic housing bore 82 behind hydraulic piston 84, hydraulic piston 84 is forced towards locking element housing 90 and reciprocating shaft 86 begins to extend from hydraulic housing 80. Fluid accumulated in the first hydraulic bore in front of hydraulic piston 84 passes through fluid passage 196, past check valve 110, to exit hydraulic housing 80 via retraction port 106. A fluid bore 210 is provided in locking element housing 90 to permit the escape of working fluid trapped within the locking element housing 90 as the inclined shoulder 122 of reciprocating shaft 86 enters the locking element housing 90. As reciprocating shaft circumferential groove 120 approaches the locking elements 136, the leading edge of hydraulic piston 84 engages retention pin 140, compressing retention pin engagement spring 141. When the circumferential groove 120 becomes aligned with the locking elements 136, retention pin first diameter portion 140*a* is fully displaced from release wedge bore 144. Release wedge 98 is then free to move away from reciprocating shaft 86 under the influence of biasing springs 134 forcing locking elements 136 into the circumferential groove 120. With the locking elements 136 engaging circumferential groove 120, displacement of reciprocating shaft 86 in either direction along a longitudiual axis of reciprorating shaft 86 is prevented. Reciprocating shaft 86 is, therefore, fully extended and locked within hydraulic housing 80**.

To effectuate unlocking and retraction, working fluid is introduced into retraction port 106. Initially, fluid is prevented by check valve 110 and back pressure valve 112 from entering into first hydraulic housing bore 82. Thus, working fluid is introduced into cavity 178 via hydraulic passage 195, release piston housing groove 192 and release piston housing opposing bores 194. As working fluid accumulates in cavity 178 under pressure, release piston 102 forces release wedge 98 towards reciprocating shaft 86, thereby displacing locking elements 136 from circumferential groove 120. When the locking elements 136 contact the inside surface of locking element housing 90, or when release piston 102 bottoms out against wedge housing 96, further displacement of release wedge 98 is prevented. Pressure in cavity 178, and correspondingly fluid passage 196, therefore continues to increase until, at a preselected pressure, back pressure valve 112 releases. Working fluid is then introduced into the forward portion of first hydraulic housing bore 80 via passage 196, past back pressure valve 112, and through fluid passage 208. Hydraulic piston 84 is then forced away from locking element housing 90 and reciprocating shaft 86 retracted into hydraulic housing 80. Movement of hydraulic piston 84 away from locking element housing 90 permits retention pin compression spring 141 to force retention pin 140 away from locking element housing 90, permitting the engagement of retention pin first diameter portion 140*a* with release wedge bore 144, thereby securing release wedge 98 in proximity to reciprocating shaft 86. Fluid continues to enter first hydraulic bore 82 ahead of hydraulic piston 84 to force hydraulic piston 84 away from locking element housing 90 until complete retraction of reciprocating shaft 86 is accomplished. Pressure within first hydraulic bore 82 and cavity 178 may then be relaxed. The retention of release wedge 98 in proximity to reciprocating shaft 86 by retention pin 140 prevents engagement of locking elements 136 with reciprocating shaft 86 until shaft 86 is again moved forward by the introduction of working fluid through extention port 104.

The above-discribed novel self-locking hydraulic actuator would be appropriate for a wide range of diverse applications. As an illustrative example only, such self-locking hydraulic actuator could be incorporated into an aircraft landing gear actuation assembly.

It will, of course, be understood that other modifications of the present inventive locking device, and its various aspects, will be apparent to those skilled in the art, some being apparent only after study and others being merely matters of routine mechanical design. For example, where symmetrical dispersal of restraining forces about the circumference of a reciprocating member is not deemed necessary, a single locking element could be used to engage a reciprocating member circumferential groove. Numerous other embodiments of the present inventive locking device are also possible with their specific designs dependent upon the particular application of the locking device. As such, the scope of the present invention should not be limited by the particular embodiments herein described, but should be defined only by the appended claims and equivalents thereof.

What is claimed is:

1. A locking device for securing a reciprocating member having at least one circumferentially disposed groove located at any preselected position, said locking device comprising:

a housing having a bore engaging said reciprocating member;

at least one curved locking element disposed within said housing bore adjacent said reciprocating member for engaging said reciprocating member circumferential groove;

at least one biasing means, disposed through said housing bore, for forcing said locking element towards said reciprocating member;

release means, disposed within said housing, for disengaging said locking element from said reciprocating member circumferential groove, wherein locking is effectuated by engagement of said locking element with said reciprocating member circumferential groove, said release means comprising a release element slidingly disposed within said housing and generally limited to movement along an axis generally perpendicular to the longitudinal axis of said reciprocating member, said release element selectively engaging said locking element such that displacement of said release element towards said reciprocating member pivotally displaces said locking element away from said reciprocating member;

said locking device further comprising:

a retention element, disposed within said housing through a bore generally parallel to the longitudinal axis of said reciprocating member, said retention element having a first surface for selectively engaging said release element and retaining said release element in proximity to said reciprocating member, wherein engagement of said retention element and said release element prevents said locking element from engaging said reciprocating member circumferential groove.

2. The locking device of claim 1 wherein said curved locking element comprises first and second sections disposed about said reciprocating member.

3. The locking device of claim 2 wherein said first and second sections are pivotally coupled to said housing by pivot pins, said pivot pins being oriented generally parallel to the longitudinal axis of said reciprocating member.

4. The locking device of claim 1 further comprising an annular ring disposed about said reciprocating member in proximity to said reciprocating member circumferential groove, wherein registration of said reciprocating member circumferential groove with said locking element disengages said retention element.

5. The locking device of claim 1 further comprising a spring disposed about said retention element and urging engagement of said retention element and said release element.

6. A self-locking hydraulic actuator comprising:

a housing defining a bore communicating with an aperture, first and second fluid passages communicating with said bore and, respectively, with first and second apertures, and a cavity communicating with a cavity aperture, said bore, and said second fluid passage;

a shaft, slidingly received within said housing bore, having a first radius, a second radius, and a circumferential groove, said first shaft radius limited to a portion of said shaft adjacent a first end of said shaft disposed within said bore and dividing said bore into a first and second chamber;

locking means, disposed within said housing bore and including engagement means for applying substantially uniform pressure about the circumferential groove, for restricting longitudinal axial displacement of said shaft, said locking means comprising:

a locking element housing disposed within said housing bore about said shaft;

at least one locking element pivotally disposed within said locking element housing adjacent said shaft for engaging said shaft circumferential groove;

at least one means for urging said locking element towards said shaft;

hydraulic release means, disposed within said housing cavity and communicating with said second fluid passage, for disengaging said locking means, said hydraulic release means comprising:

a release element slidingly disposed within said housing cavity and generally limited to movement along an axis generally perpendicular to the longitudinal axis of said shaft, said release element selectively engaging said locking element such that displacemeng of said release element towards said shaft pivotally displaces said locking element away from said shaft; and hydraulic piston means, disposed within said cavity adjacent said release element and coupled to said second fluid passage, for forcing said release element towards said shaft;

a check valve, disposed within said second fluid passage, preventing the flow of a working fluid from said second fluid passage to said housing bore; and a back pressure valve, disposed within said second fluid passage, for preventing the flow of a working fluid through said second passage to said housing bore below a preset working fluid pressure, wherein the introduction of working fluid into said bore through said first aperture and said first passage causes extension of shaft and locking of said shaft, and introduction of working fluid into said bore through said second aperture and said second passage causes unlocking and retraction of said shaft.

7. The self-locking hydraulic actuator of claim 6 further comprising retention means, disposed within said locking element housing, for selectively engaging said release element in proximity to said shaft and disengaging said release element upon registration of said locking element with said shaft circumferential groove.

8. The self-locking hydraulic actuator of claim 6 further comprising engagement indication means, disposed within said housing, for indicating engagement of said locking element with said reciprocating member circumferential groove.

* * * * *